United States Patent [19]

Long

[11] 4,323,586

[45] Apr. 6, 1982

[54] THERMALLY-PROCESSABLE FLEXIBLE PACKAGE AND PROCESS FOR USING SAME

[75] Inventor: Florren E. Long, Mount Vernon, Ohio

[73] Assignee: Ludlow Corporation, Needham Heights, Mass.

[21] Appl. No.: 198,369

[22] Filed: Oct. 20, 1980

[51] Int. Cl.[3] ..... B65B 31/02; B65B 55/06; B65D 33/02

[52] U.S. Cl. ..... 426/412; 53/434; 206/484; 229/55; 426/126; 426/410; 428/35

[58] Field of Search ..... 426/410, 412, 126, 127, 426/124, 106; 53/434, 433, 449, 405, 408; 229/55; 206/484; 428/35

[56] References Cited

U.S. PATENT DOCUMENTS

| | | | |
|---|---|---|---|
| Re. 30,098 | 9/1979 | Titchenal et al. | 206/484 |
| 2,344,369 | 3/1944 | Salfisberg | 229/55 |
| 2,898,027 | 8/1959 | Scholle | 229/55 |
| 3,108,881 | 10/1963 | Shaw et al. | 426/412 |
| 3,204,825 | 9/1965 | Underwood | 229/55 |
| 3,248,040 | 4/1966 | Friedman | 229/55 |
| 3,494,457 | 2/1970 | Titchenal | 229/55 |
| 3,545,983 | 12/1970 | Woods | 53/433 |
| 3,556,816 | 1/1971 | Nughes | 426/412 |
| 3,574,642 | 4/1971 | Weinke | 426/129 |
| 3,597,237 | 8/1971 | Nughes | 424/412 |
| 4,085,244 | 4/1978 | Stillman | 426/126 |
| 4,136,205 | 1/1979 | Quattlebaum | 426/412 |
| 4,267,960 | 5/1981 | Lind et al. | 426/127 |

FOREIGN PATENT DOCUMENTS

| | | | |
|---|---|---|---|
| 2364220 | 6/1975 | Fed. Rep. of Germany | 426/113 |
| 2531353 | 1/1977 | Fed. Rep. of Germany | 426/412 |
| 746165 | 7/1970 | France | 426/410 |
| 2362769 | 4/1978 | France | 426/410 |
| 52-20199 | 2/1977 | Japan | 426/412 |
| 951228 | 3/1964 | United Kingdom | 53/434 |
| 1378140 | 12/1974 | United Kingdom | 426/412 |

*Primary Examiner*—Steven L. Weinstein

*Attorney, Agent, or Firm*—Robert A. Cesari; John F. McKenna; Andrew F. Kehoe

[57] ABSTRACT

The invention relates to a novel duplex pouch structure which provides an improved means to package and process retortable foods and also provides a mechanically superior package which can be transported with only moderate protection, and yet will sustain minimal damage.

4 Claims, 2 Drawing Figures

THERMALLY-PROCESSABLE FLEXIBLE PACKAGE AND PROCESS FOR USING SAME

BACKGROUND OF THE INVENTION

This invention relates to a large, novel, duplex bag construction and to packages formed therewith and particularly, to improved food packages of the type which are suitable for retort and vacuum packaging and which depend upon a metal foil to achieve the necessary barrier properties. Flexible packaging articles useful in retort packaging have been known for some time. They are usually bags formed of laminates of paper or cellophane, one or more thermoplastic plies, and a metal foil ply such as aluminum foil. In general, such packages have been highly successful and continue to improve their share of the market in many packaging applications including packaging of foods wherein the packaged ingredient contains some liquid adding substantially to the weight of the package.

One consideration which must be given to such packaging when more economically desirable flexible sheets are used, is the need to provide protection from the normal abuse that must be expected during transportation over typical rail and truck routes. The problems discussed herein are of particular concern when foil-bearing laminates are used in large pouches, e.g., those having sides of about six inches, or more, or containing over a pound or more of packaged material.

A number of protective measures are known in the packaging art. One is simply to increase the gauge of the sheet materials used to withstand the abuse. In general, however, the cost of such materials has led to the use of other protective procedures. For example, "full folders" have been used wherein the package is fully enclosed in a chip board box or in a four-sided sleeve formed of light cardboard. This is a reasonably successful procedure, but it is expensive also. Use of various cushions has also been tried, these cushions being placed as sheets between the packages as they are packed in cases. Again, the cost is a significant factor and the protection leaves less than is desired.

DEFINITIONS

For purposes of the description, the term "flex crack" indicates a crease or bend in a laminate which is severe enough to suggest a weakening of, or a break in, a foil component thereof. The term "bruise" defines a condition wherein the foil component is more severely damaged as by rubbing off or disintegrating at a very small area of the package. A "leaker" is a defect wherein there is actually a hole in the laminate through which fluid may pass.

SUMMARY OF THE INVENTION

It is an object of the invention to provide an improved process for making a retortable package.

It is a further object of the invention to provide a novel pouch particularly useful in packaging of foodstuffs which are thermally processed during the packaging procedure.

Another object of the invention is to provide a novel, package containing flowable foodstuffs and resistant to damage from mechanical abuse during transportation and handling of the package.

The above objects have been substantially achieved by the utilization of the flexible pouch structure which is characterized by walls formed of at least two plys which are not laminated to one another, the inner ply being advantageously formed of a thermoplastic, e.g., polyolefin, film of at least about 0.002 inch thick and the outer wall being formed of a foil-bearing laminate conveniently of the type known in the food packaging art and also of at least about 0.002 inch thickness. An important aspect of the pouch construction is that the upper closure portion of the pouch comprises walls wherein the two plys are only partially heatsealed one to the other along the upper edge of the closure. The partial heat seal helps to shield the space between the plies from contamination. As importantly the apertures along the edge of the closure which are formed by the non-heatsealed portions of the web form conducts through which gas may be removed from between the two plys before any thermal processing of packaged materials.

ILLUSTRATIVE EMBODIMENT OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

IN THE DRAWINGS

Figure 1:
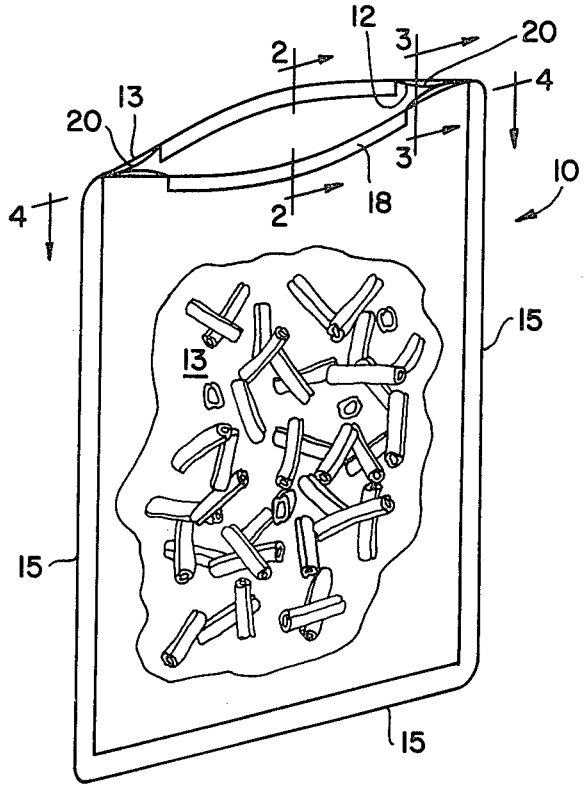
FIG. 1 is a perspective view of a pouch formed according to the invention before the pouch is sealed.
Figure 2:
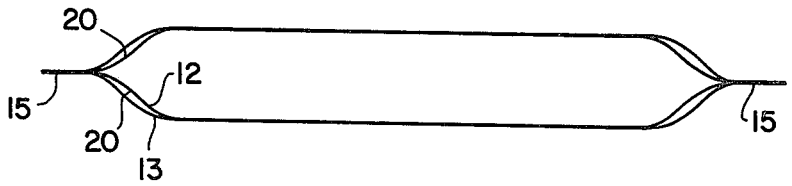
FIG. 2 is a section of the pouch of FIG. 1 taken along section line 4—4.

FIG. 1 illustrates a yet-unsealed pouch 10 formed of an interior sheet 12, a 0.003 inch-thick ply of polypropylene, and an exterior sheet 13, a laminate of 0.0005 inch polyester, 0.0007 inch thick aluminum foil, and 0.003 inch-thick polypropylene.

These sheets are formed into a bag but heatsealed along three edges of the bags perimeter but left open at the top to facilitate a filling operation.

A substantial portion of the top edges of sheets 12 and 13 are sealed together at areas 18 along the top edges of pouch 10. However, the heatsealed areas 18 must not wholly seal off the space between sheets 12 and 13 but leave openings 20.

In practice, after a pouch 10 is filled, it is subjected to a vacuum treatment in which air is removed from between sheets 12 and 13. This is particularly critical in situations because the food is to be subsequently subjected to thermal processing, e.g., cooking, sterilization or freezing procedures. Any gas trapped within the walls of the package can interfere with the proper processing of food or other materials so processed.

In mechanical abuse tests, the package of the invention is found to perform better than a comparable pouch control package (formed of a sheet 13 only) even when this control package is wholly protected by a full chipboard folder shield means. The package of the invention outperformed the fully-shielded control package with respect to bruises.

In order to run a more meaningful comparison, the full folder was removed from the control packages and only a light foam sheeting was used to avoid damage from rigid corners. This is the mode in which the pouches of the invention were tested. In this test, the incidence of leakage and bruises soared for the control pouch indicating an even greater degree of superiority for the package of the invention.

TEST PROCEDURE

The packages of the invention were nested, 6 pouches per case, in a 2/1/2/1/ bottom-to-top arrangement in a corrugated carton of 21½ inches by 13 inches by 5 inches. The carton was 275 lb. test carton and produced by Mt. Vernon Packaging, Inc. of Mt. Vernon, Ohio.

Between the nested layers of pouches were foam separator sheets (21 inches by 13 inches by 0.125 inch) of thin microfoam. This material, known to the packaging art, is helpful in avoiding damage which can be inflicted by the relatively rigid heatsealed corners of the pouches.

The pouches were of the C type—the seals were ⅜ inch wide and the pouch was 10 inches by 15 inches. Each side of an inner ply of 3 mils of polypropylene was heatsealed to an exterior ply along three sides leaving a closure section at the top, or fourth side. The inner ply was tacked to the adjacent lip of the exterior ply by heatsealing at 3 points. However, the spaces between such tack-seals allowed the space between interior and exterior ply to remain open to atmosphere. The exterior ply was, from the exterior part of the bag inwardly, 0.0005 inch polyester, 0.0007 inch aluminum foil and 0.003 inch polypropylene. A commercially available priming system, one based on a propylene/maleic anhydride adduct was used at the aluminum/polypropylene interface, as is known to the art. The priming system is available commercially from Morton Chemicals Company.

The pouches were filled with a commercially canned product, 3 lbs., 12 ounces of cut green beans, salt added as is known in the food-canning art. About 250 ml. (8 oz.) of the canned brine was also added. It was found preferable to add the liquid before the solids, but, this related more to preferred packaging technique than to package performance.

Before sealing, the package was subjected to a five second vacuum cycle at a vacuum of 25.5 inches of mercury. This vacuum, in addition to its conventional function, assures that little or no insulating gas will be left between the plies of the duplexed bag. The packages were then sealed with a conventional heatsealing cycle and cooked in a retort for 14 minutes at 250° F.

The packed cases were subjected to vibration on a test apparatus designed to simulate, over a short time period, vibrations which may be encountered by the packages in normal shipping operations. The particular tester used was that known as "Package Tester S.N.V.M.C.; Type 400". Such shipping simulation testers are well known in the art and are available from L.A.B. Corp. The test cases were vibrated for 30 minutes at about 200 cycles per minute. Two cases were tested with the long dimension of the pouch parallel to the movement of the tester and two cases were tested with the shorter dimension of the pouch perpendicular to the movement of the tester.

After the "shipping" action was terminated, the cases were numbered according to ASTM D-775-61 and dropped from a height of 12 inches onto a hard surface so that the so-called 2-3-5 corner was impacted, dropped again so that the 3-5 edge was impacted, and dropped three more times so that the 5 end, the 2-side and the 3 bottom were, in turn, all impacted.

No leaks were observed in any of the cases. No bruising was detected—although an olive drab color on the outside of the package made such detection very difficult. A number of flex cracks were found, averaging about 1.2 per pouch. About 85% of these were small or very small.

In this application, a "flowable foodstuff" includes liquids or slurries such as cut vegetable or meat in a liquid medium. "Retortable" is defined as meaning a package that can withstand temperature as high as 250° F. for up to about two hours without any mechanical defects being caused by this thermal treatment.

It is also to be understood that the following claims are intended to cover all of the generic and specific features of the invention herein described and all statements of the scope of the invention which might be said to fall therebetween.

What is claimed is:

1. In a pouch for use in the packaging and subsequent secure transporting of food, the improvement wherein said pouch is formed of two flexible sealable wall panels, said panels each being formed of an inner sheet and an adjacent outer sheet and said panels and the sheets from which they are formed being sealed together about the lateral and bottom edges of said panels and said panels being unsealed to each other across their upper edges to form an open topped pouch; said inner sheet and adjacent outer sheet of each panel being unsealed to each other between the lateral and bottom edges to define an unsealed space; the upper edge of each said wall panel comprising a major central portion therealong, which comprises a sealed edge shield, formed of the upper edge of said inner sheet and said outer sheet of each said panel being sealed together, said shield forming means to prevent contamination of said space between said inner sheets and said adjacent outer sheets during pouch-filling; and unsealed conduit means to vent said space between each of said inner sheets and each adjacent outer sheet, said conduit means being formed at the sides of each panel and between the ends of each said shield means and a sealed lateral edge adjacent to said shield means.

2. A pouch as defined in claim 1 wherein each of said panels comprises a foil-bearing laminate outer sheet and a heat-sealable polymeric inner sheet.

3. A pouch as defined in claim 1 wherein said inner sheet is formed of polyolefin film of at least 2 mils in thickness.

4. In a process for packaging food in a flexible sealable pouch and including the step of thermally-treating such food, the improvement wherein (1) said food is placed into the open-topped pouch of claim 1, (2) filling said pouch while shielding said unsealed space between said sheets from contamination with food by said sealed edge shield, then (3) subjecting said pouch to a sub-atmospheric pressure, removing any excessive insulating gas from between said sheets through said unsealed conduit means, (4) and then sealing the upper edges of said pouch leaving said inner sheet and adjacent outer sheet of each panel in non-laminated relationship and thermally processing the sealed pouch.

* * * * *